US008965240B2

(12) United States Patent
Yonemoto

(10) Patent No.: US 8,965,240 B2
(45) Date of Patent: Feb. 24, 2015

(54) CLEANING DEVICE, INTERMEDIATE TRANSFER UNIT INCLUDING THE SAME, AND IMAGE FORMING APPARATUS INCLUDING THE SAME

(71) Applicant: Kyocera Document Solutions Inc., Osaka (JP)

(72) Inventor: Satoru Yonemoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/094,036

(22) Filed: Dec. 2, 2013

(65) Prior Publication Data

US 2014/0153957 A1 Jun. 5, 2014

(30) Foreign Application Priority Data

Nov. 30, 2012 (JP) ..... 2012-262263

(51) Int. Cl.
*G03G 15/16* (2006.01)

(52) U.S. Cl.
CPC ..... *G03G 15/161* (2013.01); *G03G 2215/0132* (2013.01)
USPC ..... 399/101; 399/123; 399/357

(58) Field of Classification Search
USPC ..... 399/101, 123, 357
See application file for complete search history.

(56) References Cited

U.S. PATENT DOCUMENTS 4,939,552 A * 7/1990 Nakanishi ..... 399/352
5,970,872 A * 10/1999 Iwamoto et al. ..... 101/423

FOREIGN PATENT DOCUMENTS

JP 2010210727 9/2010

* cited by examiner

*Primary Examiner* — Ryan Walsh
(74) *Attorney, Agent, or Firm* — K&L Gates LLP

(57) ABSTRACT

A cleaning device includes a housing, a cleaning member, a contact member, a torque limiter, and an urging member. The housing has an opening that opposes an image carrier and a waste toner receiver. The cleaning member includes a rotation member that is rotated in a forward rotation direction. The cleaning member is positioned near the opening in the housing and removes residual toner from the surface of the image carrier. The contact member is positioned so as to be in contact with an outer peripheral surface of the rotation member. The torque limiter is located on a rotation shaft of the rotation member and is capable of rotating independently of the rotation shaft when a torque that is greater than or equal to a predetermined torque is applied to the torque limiter. The urging member applies an urging force to the torque limiter in a reverse rotation direction.

9 Claims, 11 Drawing Sheets

CLEANING DEVICE, INTERMEDIATE TRANSFER UNIT INCLUDING THE SAME, AND IMAGE FORMING APPARATUS INCLUDING THE SAME

INCORPORATION BY REFERENCE

This application is based upon, and claims the benefit of priority from, corresponding Japanese Patent Application No. 2012-262263, filed in the Japan Patent Office on Nov. 30, 2012, the entire contents of which are incorporated herein by reference.

BACKGROUND

The present disclosure relates to a cleaning device including a mechanism for removing residual toner from a surface of an image carrier by using a cleaning member.

In electrophotographic image forming apparatuses, such as copy machines, printers, and facsimile machines, images are generally formed by using toner. A visible image (toner image) formed on an image carrier, such as a photoconductor drum or an intermediate transfer belt, is transferred onto a recording medium, and is then fixed to the recording medium. Toner that remains on the surface of the image carrier is removed by a cleaning device, and a new toner image is then formed on the image carrier.

An example of a cleaning device includes a cleaning member that removes the toner from the surface of the image carrier, a scraper that scrapes off the toner from the surface of the cleaning member, and a conveyor spiral that discharges the toner that has been scraped off to the outside.

Another example of a cleaning device includes a swing mechanism that swings a cleaning member in a circumferential direction of rotation of an image carrier while causing the cleaning member to slide along the surface of the image carrier.

SUMMARY

According to an embodiment of the present disclosure, a cleaning device is provided that includes a housing, a cleaning member, a contact member, a torque limiter, and an urging member. The housing has an opening that opposes an image carrier and a waste toner receiver that receives toner that has been scraped off a surface of the image carrier. The cleaning member includes a rotation member that is rotated in a forward rotation direction. The cleaning member is positioned near the opening in the housing and removes residual toner from the surface of the image carrier by rotating the rotation member in a forward direction. The contact member is positioned so as to be in contact with an outer peripheral surface of the rotation member. The torque limiter is located on a rotation shaft of the rotation member and is capable of rotating independently of the rotation shaft when a torque that is greater than or equal to a predetermined torque is applied to the torque limiter. The urging member applies an urging force to the torque limiter in a reverse rotation direction. When T1 is the torque required to rotate the torque limiter independently of the rotation shaft, T2 is the rotation torque of the rotation member, F is the urging force of the urging member, and L is the distance between a position at which the urging member urges the torque limiter and a rotation center of the torque limiter, $(F \times L) < T1 < T2 - (F \times L)$ is satisfied.

According to another embodiment of the present disclosure, an intermediate transfer device includes the above-described cleaning device and an intermediate transfer belt from which the residual toner is removed by the cleaning device.

Additional features and advantages are described herein, and will be apparent from the following Detailed Description and the figures.

DETAILED DESCRIPTION

Figure 1:
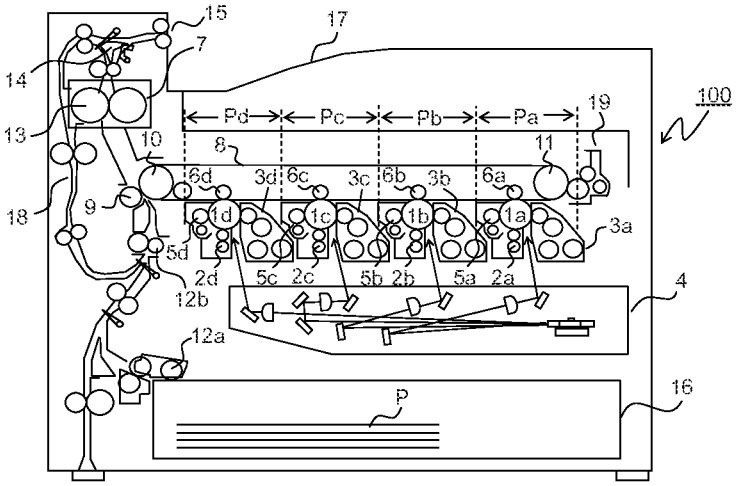
FIG. 1 is a schematic diagram illustrating the inner structure of an image forming apparatus including a belt cleaning unit according to an embodiment of the present disclosure.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
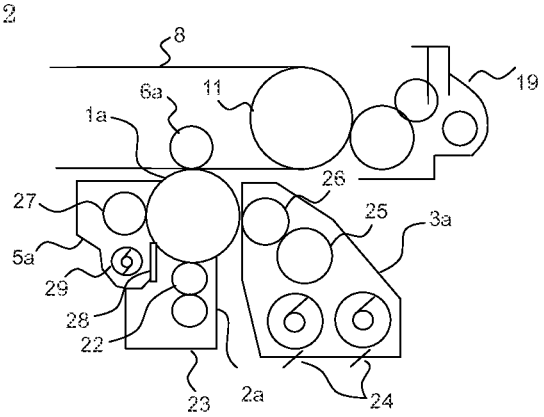
FIG. 2 is an enlarged view of a region around an image forming unit in FIG. 1.
Figure 3:
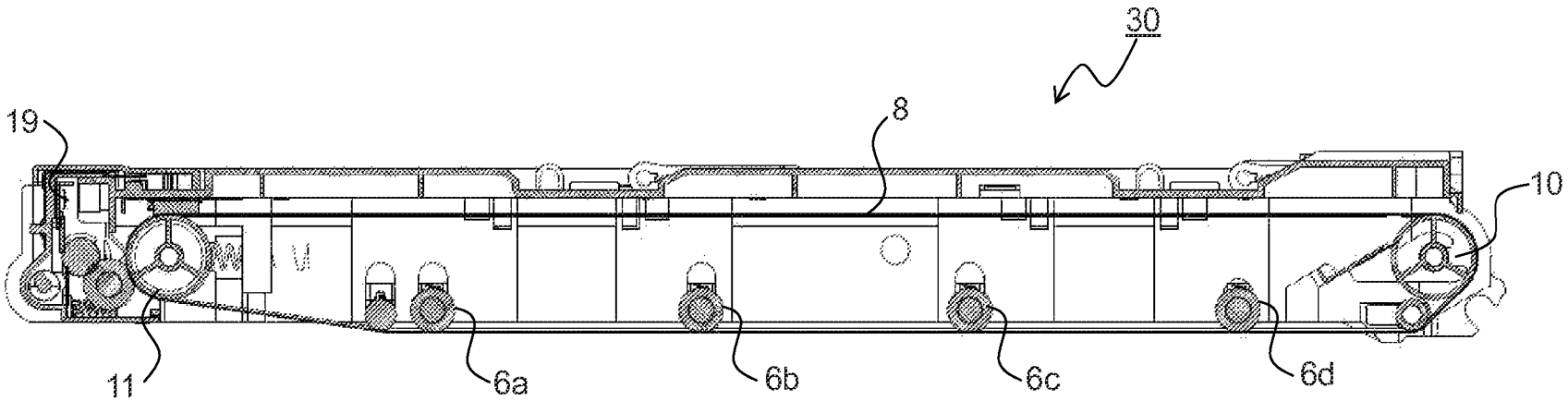
FIG. 3 is a side sectional view of an intermediate transfer unit mounted in the image forming apparatus according to an embodiment of the present disclosure.

An embodiment of the present disclosure will now be described with reference to the drawings. FIG. 1 is a schematic diagram illustrating the structure of an image forming apparatus 100 including a belt cleaning unit 19, which is a cleaning device according to an embodiment of the present disclosure. FIG. 2 is an enlarged view of a region around an image forming unit Pa in FIG. 1. FIG. 3 is a side sectional view of an intermediate transfer unit 30 mounted in the image forming apparatus 100. FIG. 3 shows the intermediate transfer unit 30 viewed from the rear in FIG. 1.

The image forming apparatus 100 illustrated in FIG. 1 has the following structure. The image forming apparatus 100 includes four image forming units Pa, Pb, Pc, and Pd arranged in the main body thereof in order from an upstream side (right side in FIG. 1) in a conveying direction. The image forming units Pa to Pd are provided to form images of four different colors (cyan, magenta, yellow, and black), and successively form cyan, magenta, yellow, and black images by performing the steps of charging, exposure, developing, and transferring.

The image forming units Pa to Pd respectively include photoconductor drums 1*a*, 1*b*, 1*c*, and 1*d*, which carry visible images (toner images) of the respective colors. An intermediate transfer belt 8 is arranged next to the image forming units Pa to Pd, and is rotated clockwise in FIG. 1 by a driving unit (not shown). The toner images formed on the photoconductor drums 1*a* to 1*d* are successively transferred onto the intermediate transfer belt 8, which moves while being in contact with the photoconductor drums 1*a* to 1*d*, and are then simultaneously transferred onto a transfer sheet P, which is an example of a recording medium, by a second transfer roller 9. Then, the toner images are fixed to the transfer sheet P by a fixing unit 7. The transfer sheet P to which the toner images have been fixed is ejected outside of the main body of the apparatus. Each of the photoconductor drums 1*a* to 1*d* is subjected to an image forming process while being rotated counterclockwise in FIG. 1.

Transfer sheets P, onto which toner images are to be transferred, are contained in a paper cassette 16 located in a lower section of the main body of the image forming apparatus 100, and are fed to the second transfer roller 9 by a paper feed roller 12*a* and a pair of registration rollers 12*b*. The intermediate transfer belt 8 is basically a seamless belt formed of a dielectric resin sheet.

The image forming units Pa to Pd will now be described. Charging devices 2*a*, 2*b*, 2*c*, and 2*d* that charge the photoconductor drums 1*a* to 1*d*, an exposure unit 4 that subjects the photoconductor drums 1*a* to 1*d* to an exposure process based on the image information, developing unit 3*a*, 3*b*, 3*c*, and 3*d* that form toner images on the photoconductor drums 1*a* to 1*d*, and cleaning devices 5*a*, 5*b*, 5*c*, and 5*d* that remove developer (toner) remaining on the photoconductor drums 1*a* to 1*d*, are positioned around and below the photoconductor drums 1*a* to 1*d*, which are rotatable.

The image forming unit Pa will now be described in detail with reference to FIG. 2. The structures of the image forming units Pb to Pd are basically similar to that of the image forming unit Pa, and the descriptions thereof are thus omitted. As illustrated in FIG. 2, the charging device 2*a*, the developing unit 3*a*, and the cleaning device 5*a* are arranged around the photoconductor drum 1*a* in the rotation direction of the photoconductor drum 1*a* (counterclockwise in FIG. 1). A first transfer roller 6*a* opposes the photoconductor drum 1*a* with the intermediate transfer belt 8 interposed therebetween. A belt cleaning unit 19, which opposes a tension roller 11 with the intermediate transfer belt 8 interposed therebetween, is positioned upstream of the photoconductor drum 1*a* in the rotation direction of the intermediate transfer belt 8.

The charging device 2*a* includes: a charging roller 22 that contacts the photoconductor drum 1*a* and applies a charging bias to the drum surface; and a charging cleaning member 23 for cleaning the charging roller 22. The developing unit 3*a* includes two stirring-and-conveying screws 24, a magnetic roller 25, and a developing roller 26, and a developing bias having the same polarity (positive) as that of the toner is applied to the developing roller 26, so that the toner is transferred onto the drum surface.

The cleaning device 5*a* includes a sliding roller 27, a cleaning blade 28, and a collecting screw 29. The sliding roller 27 is pressed against the photoconductor drum 1*a* at a predetermined pressure, and is rotated by a driving unit (not shown) such that contact surfaces of the sliding roller 27 and the photoconductor drum 1*a* move in the same direction but the peripheral speed of the sliding roller 27 is greater than (1.2 times in this example) that of the photoconductor drum 1*a*. The sliding roller 27 may include, for example, a metal shaft and a roller body located around the metal shaft, the roller body being a foam layer made of EPDM rubber and having an Asker C hardness of 55°. The material of the roller body is not limited to EPDM rubber, and other rubber materials or foamed rubber bodies may be used. The Asker C hardness of the material is preferably in the range of 10° to 90°.

The cleaning blade 28 is secured in such a manner that the cleaning blade 28 is in contact with the surface of the photoconductor drum 1*a* at a position downstream of the position at which the sliding roller 27 is in contact with the surface of the photoconductor drum 1*a* in the rotation direction. The cleaning blade 28 may be, for example, a polyurethane rubber blade having a JIS hardness of 78°, and is at a predetermined angle with respect to a tangent line of the photoconductor drum at the point of contact of the cleaning blade 28. The material, hardness, and size of the cleaning blade 28, the amount by which the cleaning blade 28 is depressed into the photoconductor drum 1*a*, the pressing force applied to the cleaning blade 28, etc., are set as appropriate based on the specifications of the photoconductor drum 1*a*.

The residual toner that has been removed from the surface of the photoconductor drum 1*a* by the sliding roller 27 and the cleaning blade 28 is discharged outside of the cleaning device 5*a* by the rotation of the collecting screw 29, and is fed to and collected in a toner collection container (not shown). With respect to the toner according to the present disclosure, particles of abrasive, such as silica, titanium oxide, strontium titanate, or alumina, are retained on the surfaces of toner particles by being partially embedded in the surfaces of the toner particles or are electrostatically bonded to the surfaces of the toner particles.

As illustrated in FIG. 3, the intermediate transfer unit 30 includes the intermediate transfer belt 8 that is stretched between a driving roller 10 positioned at a downstream side, a tension roller 11 positioned at an upstream side, and first transfer rollers 6*a* to 6*d* that respectively oppose the photoconductor drums 1*a* to 1*d* with the intermediate transfer belt 8 interposed therebetween. The belt cleaning unit 19 for removing the toner that remains on the surface of the intermediate transfer belt 8 is positioned so as to oppose the tension roller 11. The detailed structure of the belt cleaning unit 19 will be described below.

An image forming process performed by the image forming apparatus 100 will now be described. When an instruction to start an image forming operation is inputted to the image forming apparatus by a user, first, the surfaces of the photoconductor drums 1*a* to 1*d* are uniformly charged by the charging devices 2*a* to 2*d*. Then, the surfaces of the photoconductor drums 1*a* to 1*d* are irradiated with light by the exposure unit 4, so that electrostatic latent images corresponding to image signals are formed on the photoconductor drums 1*a* to 1*d*. The developing units 3*a* to 3*d* are filled with predetermined amounts of cyan, magenta, yellow, and black toner by supply devices (not shown). The toner is supplied to the photoconductor drums 1*a* to 1*d* by the developing units 3*a* to 3*d*, respectively, and are caused to adhere to the photoconductor drums 1*a* to 1*d* by static electricity. Thus, toner images are formed which correspond to the electrostatic latent images formed by the exposure process performed by the exposure unit 4.

The first transfer rollers 6*a* to 6*d* generate electric fields between the first transfer rollers 6*a* to 6*d* and the photoconductor drums 1*a* to 1*d* by applying predetermined transfer voltages, so that the cyan, magenta, yellow, and black toner images on the photoconductor drums 1*a* to 1*d* are transferred onto the intermediate transfer belt 8. The images of four colors are formed so as to be in a predetermined positional relationship for forming a predetermined full-color image.

Then, toner that remains on the surfaces of the photoconductor drums 1*a* to 1*d* are removed by the cleaning devices 5*a* to 5*d* to prepare for the subsequent process of forming new electrostatic latent images.

When a drive motor (not shown) starts to rotate the driving roller 10 so that the intermediate transfer belt 8 rotates clockwise, a transfer sheet P is fed from the pair of registration rollers 12*b* to the second transfer roller 9, which is located next to the intermediate transfer belt 8, at a predetermined time. Then, the full-color image is transferred onto the transfer sheet P. The transfer sheet P onto which the toner images have been transferred is fed to the fixing unit 7. The toner that remains on the surface of the intermediate transfer belt 8 is removed by the belt cleaning unit 19.

The transfer sheet P that has been fed to the fixing unit 7 is heated and pressed by a pair of fixing rollers 13, so that the toner images are fixed to the surface of the transfer sheet P and a predetermined full-color image is formed. The direction in which the transfer sheet P having the full-color image formed thereon is fed is determined by a branching portion 14 that branches in a plurality of directions. In the situation where an image is to be formed on only one side of the transfer sheet P, the transfer sheet P is ejected onto an output tray 17 by output rollers 15.

In the situation where images are to be formed on both sides of the transfer sheet P, only a portion of the transfer sheet P that has passed through the fixing unit 7 is ejected outside of the apparatus by the output rollers 15. Then, the output rollers 15 are rotated in the reverse direction and the branching portion 14 causes the transfer sheet P to travel along a sheet conveying path 18, so that the transfer sheet P reaches the second transfer roller 9 again in such a manner that the image side is reversed. Then, the next image formed on the intermediate transfer belt 8 is transferred by the second transfer roller 9 onto the surface of the transfer sheet P that has no image formed thereon. Then, the transfer sheet P is fed to the fixing unit 7, where the toner images are fixed, and is ejected onto the output tray 17.

Figure 4:
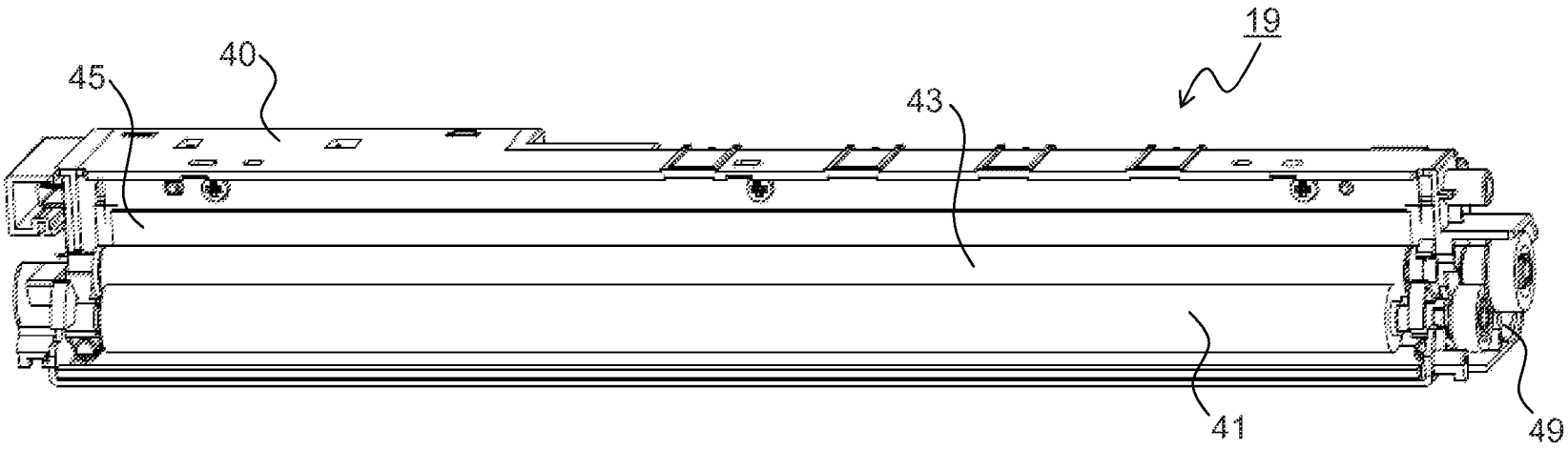
FIG. 4 is a perspective view of a belt cleaning unit according to an embodiment of the present disclosure.
Figure 5:
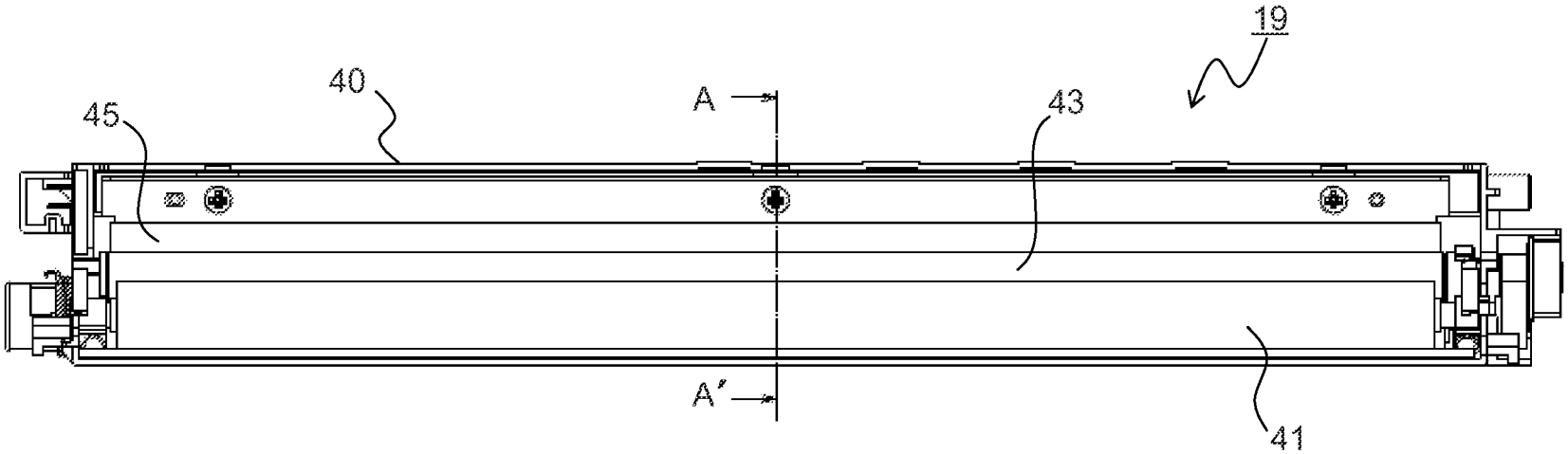
FIG. 5 is a front view of the belt cleaning unit according to an embodiment of the present disclosure viewed from the intermediate transfer belt.
Figure 6:
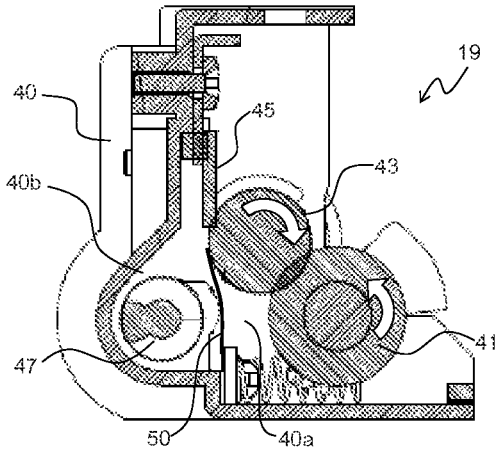
FIG. 6 is a side sectional view illustrating the inner structure of the belt cleaning unit according to an embodiment of the present disclosure.

FIG. 4 is a perspective view of the belt cleaning unit 19 illustrated in FIG. 3. FIG. 5 is a front view of the belt cleaning unit 19 viewed from the intermediate transfer belt 8 (from the right in FIG. 3). FIG. 6 is a side sectional view illustrating the inner structure of the belt cleaning unit 19 (sectional view of FIG. 5 taken along line A-A').

The belt cleaning unit 19 includes a housing 40 and a fur brush (cleaning roller) 41, a collecting roller 43, a scraper 45, and a conveyor spiral 47 disposed in the housing 40. A driving input gear train 49, which drives the fur brush 41, the collecting roller 43, and the conveyor spiral 47 in association with each other, is connected to an end of the housing 40. The fur brush 41 is arranged so as to oppose the tension roller 11 with the intermediate transfer belt 8 interposed therebetween in an opening-40*a*-side section of the housing 40. The fur brush 41 rotates in a direction counter to the movement direction of the intermediate transfer belt 8 (counterclockwise in FIG. 6), thereby scraping off foreign matter, such as toner and paper dust, that remains on the intermediate transfer belt 8 (hereinafter referred to simply as foreign matter). The foreign matter that has been scraped off adheres to a brush portion of the fur brush 41.

The collecting roller 43 rotates in a direction opposite to the rotation direction of the fur brush 41 (clockwise in FIG. 6) while being in contact with the surface of the fur brush 41, thereby collecting the foreign matter that has adhered to the fur brush 41. The scraper 45 contacts the collecting roller 43 in a direction from the downstream side along the rotation direction of the collecting roller 43 (in a direction counter to the movement direction of the surface of the collecting roller 43). The scraper 45 cleans the collecting roller 43 by scraping off the foreign matter that has been collected by the collecting roller 43. The conveyor spiral 47 is located in a waste toner receiver 40*b* of the housing 40, and feeds the foreign matter that has been scraped off from the collecting roller 43 by the scraper 45 to the outside of the housing 40.

As illustrated in FIG. 6, a toner receiving seal member 50 is positioned in the housing 40 so as to oppose the collecting roller 43 over the entire length of the collecting roller 43. The toner receiving seal member 50 is in contact with the collecting roller 43 at a predetermined contact pressure, thereby dividing the housing 40 into the opening-40*a*-side section and a waste-toner-receiver-40*b*-side section. The contact pressure applied to the toner receiving seal member 50 is set such that the toner that has adhered to the collecting roller 43 is not scraped off but the toner that has been scraped off by the scraper 45 does not travel toward the collecting roller 43 (into the opening-40*a*-side section) again.

In addition, end seal members (not shown) are provided in the housing 40 at positions near the ends of the scraper 45. The end seal members are made of, for example, an elastic material, such as foamed urethane, and prevent toner leakage through gaps between the housing 40 and bearings (not shown) of the collecting roller 43.

Figure 7:
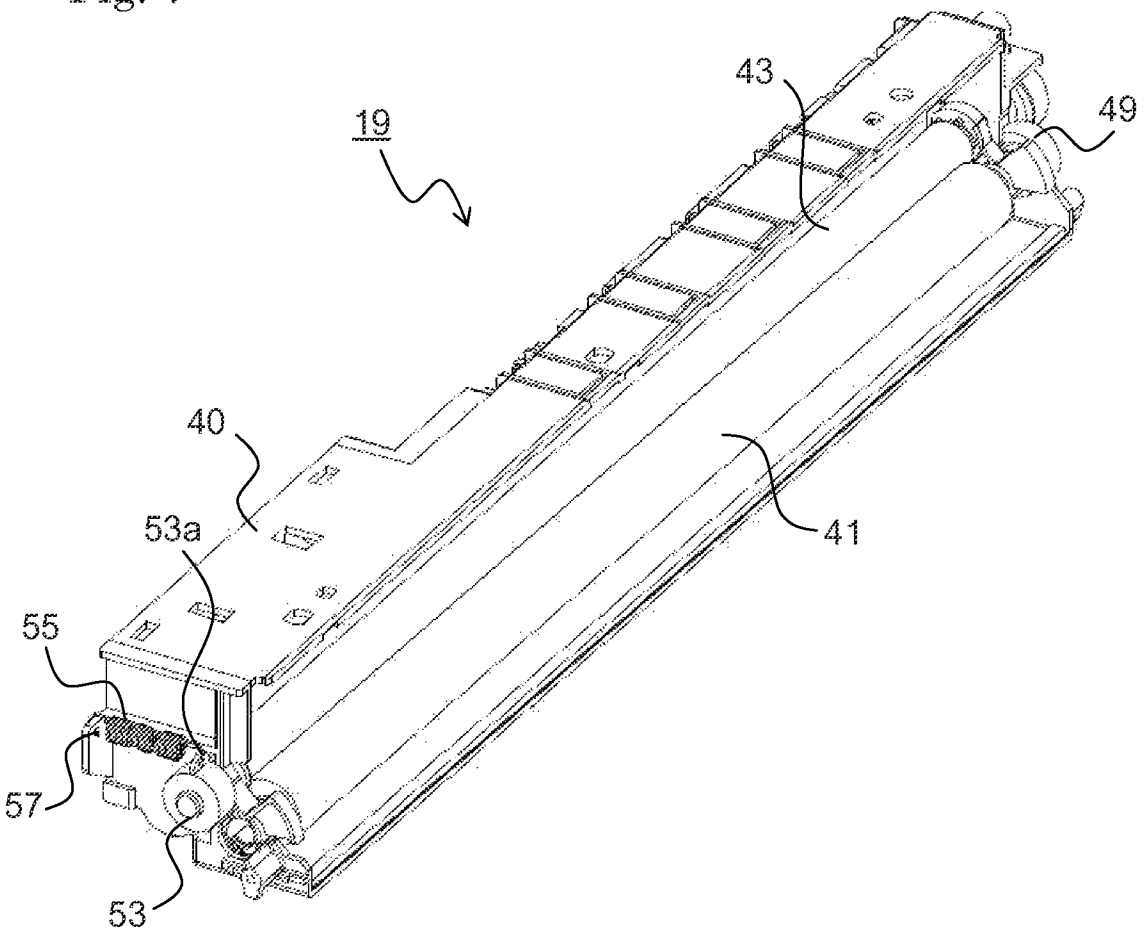
FIG. 7 is a perspective view of the belt cleaning unit according to an embodiment of the present disclosure viewed from the front left in FIG. 4.
Figure 8:
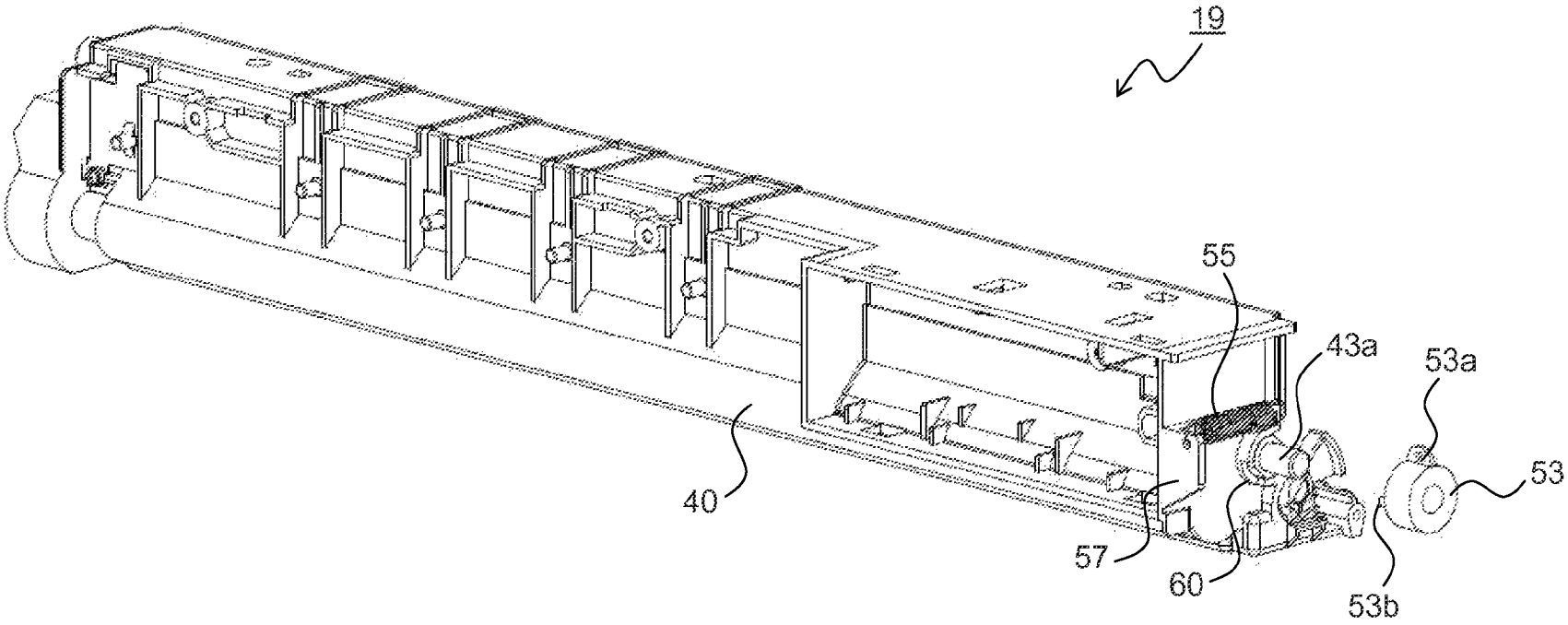
FIG. 8 is a perspective view of the belt cleaning unit according to an embodiment of the present disclosure viewed from the rear in FIG. 7.
Figure 9:
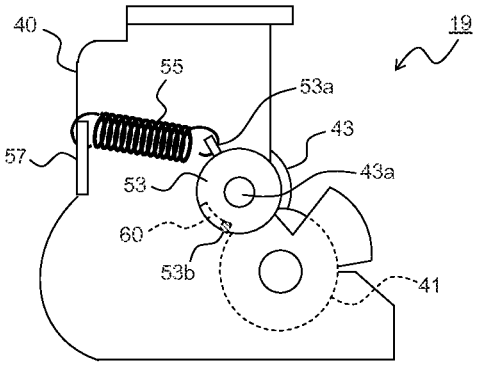
FIG. 9 is a side view of the belt cleaning unit according to an embodiment of the present disclosure viewed from the left in FIG. 4.

FIG. 7 is a perspective view of the belt cleaning unit 19 viewed from the front left in FIG. 4. FIG. 8 is a perspective view of the belt cleaning unit 19 viewed from the rear in FIG. 7. FIG. 9 is a side view of the belt cleaning unit 19 viewed from the left in FIG. 4. In FIG. 8, a torque limiter 53 is shown at a position shifted forward from its actual position for convenience of description.

The collecting roller 43 includes a rotation shaft 43*a* that is connected to the driving input gear train 49 at one end thereof and to the torque limiter 53 at the other end thereof. The torque limiter 53 is capable of independently rotating the rotation shaft 43*a* when a torque T1 applied to the torque limiter 53 is greater than or equal to a predetermined torque. The torque limiter 53 includes a cylindrical main body and an engagement portion 53*a* formed on the outer peripheral surface of the main body, the engagement portion 53*a* being engaged with an end of a tension spring 55. The other end of the tension spring 55 is retained by a retaining portion 57 formed on the housing 40. Accordingly, an urging force F that tries to rotate the torque limiter 53 counterclockwise in FIG. 6 is generated by the tension spring 55.

A projection 53*b* that projects toward the housing 40 is formed on a side surface of the torque limiter 53 that opposes the housing 40. An arc-shaped cut 60 that is centered on the rotation shaft 43*a* is formed in a side surface of the housing 40 that opposes the side surface of the torque limiter 53. The projection 53*b* is engaged with the cut 60, so that the torque limiter 53 is rotatable relative to the housing 40 within a range corresponding to the cut 60. When the rotation shaft 43*a* is not rotated, due to the urging force F generated by the tension spring 55, the torque limiter 53 is stationary at a position where the projection 53*b* is in contact with the bottom end of the cut 60 (upstream end of the cut 60 in the forward rotation direction of the rotation shaft 43*a*), as illustrated in FIG. 9.

A cleaning operation performed by the above-described belt cleaning unit 19 will now be described. When a motor (not shown) is driven so as to rotate the driving input gear train 49 from the state illustrated in FIG. 9, the fur brush 41 and the collecting roller 43 start to rotate counterclockwise and clockwise (in the forward rotation direction), respectively, as illustrated in FIG. 6. The conveyor spiral 47 also starts to rotate in a predetermined direction.

At this time, the torque limiter 53 receives a rotation torque T2 in the forward rotation direction transmitted from the rotation shaft 43*a* of the collecting roller 43 and the urging force F in the counterclockwise direction (reverse rotation direction) applied by the tension spring 55. The moment of force obtained as the product (F×L) of the urging force F applied to the torque limiter 53 by the tension spring 55 and the distance L between the position at which the tension spring 55 urges the torque limiter 53 (position of the engagement portion 53*a*) and the rotation center of the torque limiter 53 is less than the rotation torque T2 transmitted to the torque limiter 53, and is also less than the torque T1 required to rotate the torque limiter 53 independently of the rotation shaft 43*a*. Therefore, the torque limiter 53 rotates in the forward rotation direction together with the rotation shaft 43*a* while stretching the tension spring 55.

Figure 10:
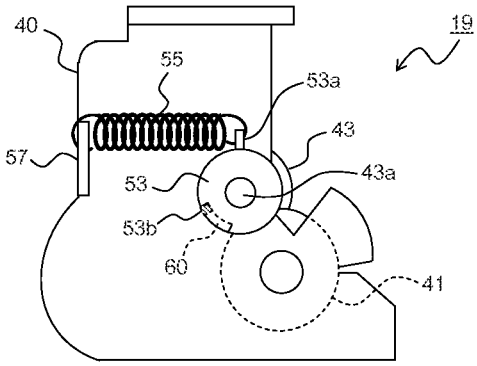
FIG. 10 is a side view of the belt cleaning unit illustrating the state in which a collecting roller has rotated forward from the state illustrated in FIG. 9.

When the torque limiter 53 is rotated by a predetermined angle together with the rotation shaft 43*a*, as illustrated in FIG. 10, the projection 53*b* of the torque limiter 53 is also rotated in the forward direction and comes into contact with a downstream end of the cut 60 in the forward rotation direction. Accordingly, the rotation torque T2 applied by the rotation shaft 43*a* is transmitted to the torque limiter 53 as a reactive force from the downstream end of the cut 60.

The torque (reactive force) T2 transmitted to the torque limiter 53 is greater than the torque T1 required to rotate the torque limiter 53 independently of the rotation shaft 43*a*. Therefore, the torque limiter 53 is retained at the position illustrated in FIG. 10 in such a state that the tension spring 55 is stretched, and only the rotation shaft 43*a* is rotated in the forward rotation direction. As a result, as illustrated in FIG. 6, the fur brush 41 is rotated counterclockwise and the collecting roller 43 is rotated clockwise, so that the intermediate transfer belt 8 is cleaned.

Figure 11:
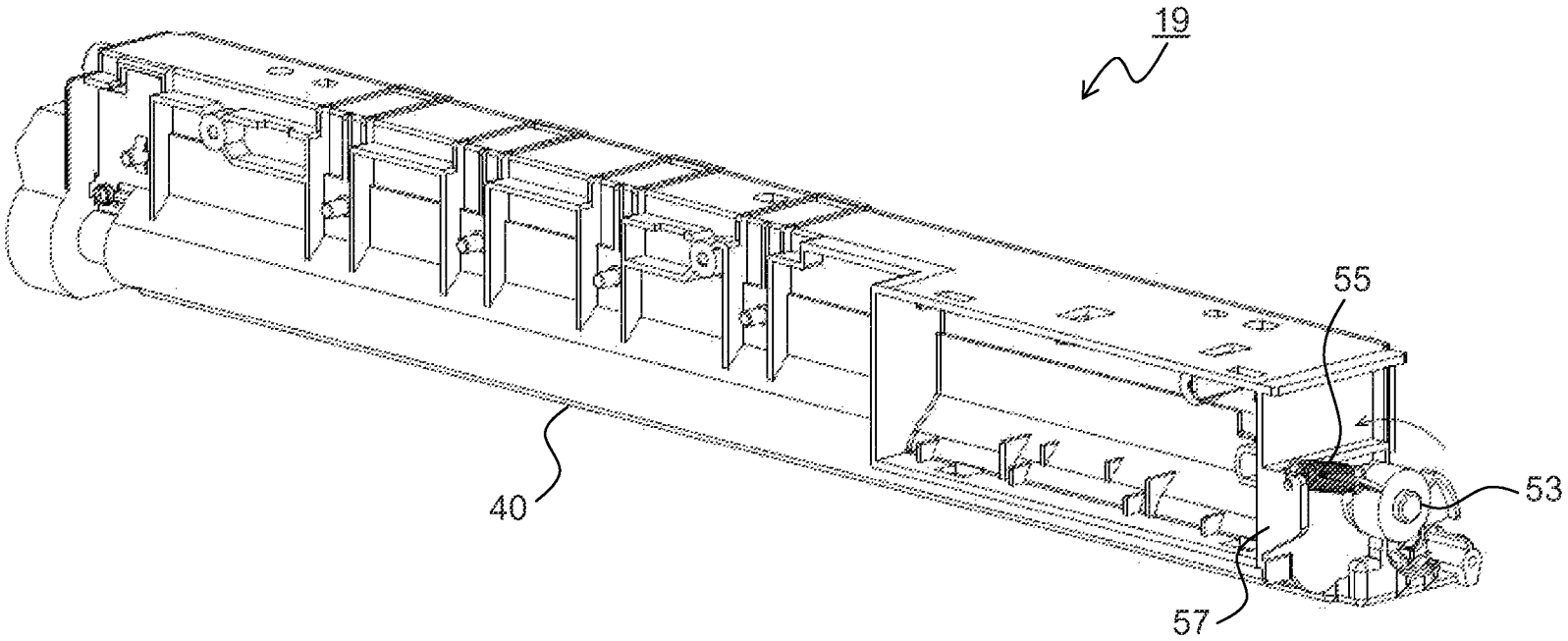
FIG. 11 is a perspective view of the belt cleaning unit viewed from the rear in FIG. 7.

To end the cleaning operation of the intermediate transfer belt 8, the motor is stopped from the state illustrated in FIG. 10. Accordingly, transmission of the driving force to the rotation shaft 43*a* is stopped, and transmission of the rotation torque T2 in the forward rotation direction from the rotation shaft 43*a* to the torque limiter 53 is also stopped. As a result, the torque limiter 53 receives only the urging force F in the reverse rotation direction from the tension spring 55 that has been stretched. Therefore, as illustrated in FIG. 11, the torque limiter 53 is rotated in the reverse rotation direction together with the rotation shaft 43*a* by the moment of force expressed as F×L, and stops at the position where the projection 53*b* is in contact with the upstream end of the cut 60 in the forward rotation direction, as illustrated in FIG. 9.

The driving input gear train 49 includes a one-way clutch which allows transmission of the driving force only in one direction. Therefore, even when the collecting roller 43 is rotated in the reverse direction, the fur brush 41 and the conveyor spiral 47 do not rotate in the reverse direction, and the toner is prevented from being scattered from the belt cleaning unit 19.

In the above-described structure, the torque T1 required to rotate the torque limiter 53 independently of the rotation shaft 43*a*, the rotation torque T2 of the rotation shaft 43*a*, the urging force F of the tension spring 55, and the distance L between the position at which the tension spring 55 urges the torque limiter and the rotation center of the torque limiter satisfy $(F\times L)<T1<T2-(F\times L)$. Accordingly, when the collecting roller 43 is rotated by the rotation of the motor that drives the belt cleaning unit 19, the tension spring 55 is stretched and stores energy. In the state in which the torque limiter 53 is stationary at a predetermined position, the fur brush 41 and the collecting roller 43 are rotated in the forward directions thereof and the operation of cleaning the intermediate transfer belt 8 is performed.

When the motor is stopped, the energy that has been stored in the tension spring 55 is released and the torque limiter 53 is rotated in the reverse direction within the range corresponding to the cut 60. The collecting roller 43 is also rotated in the reverse direction by a predetermined amount together with the torque limiter 53. As a result, the toner, paper dust, etc., that have been stuck between the collecting roller 43 and the scraper 45 fall, so that the risk of a cleaning failure can be effectively reduced.

Since the rotatable range of the torque limiter 53 is limited by the engagement between the projection 53*b* of the torque limiter 53 and the cut 60 in the housing 40, there is no risk that the tension spring 55 will be pulled by an unnecessarily large amount when the collecting roller 43 is rotated in the forward direction. In addition, the torque limiter 53 can be reliably maintained in a stationary state while the collecting roller 43 is being rotated in the forward direction, and variations in the rotation torque applied to the collecting roller 43 can be suppressed.

Furthermore, no additional mechanism is required to rotate the collecting roller 43 in the reverse direction, and it is not necessary to perform control for rotating the motor in the reverse direction. Therefore, the belt cleaning unit 19 is inexpensive and has a simple structure.

The toner receiving seal member 50 (see FIG. 6) is in contact with the collecting roller 43, and there is a possibility that toner, paper dust, etc., will also be stuck between the collecting roller 43 and the toner receiving seal member 50. However, when the collecting roller 43 is rotated in the reverse direction by a predetermined amount as in the present embodiment, toner, paper dust, etc., stuck between the collecting roller 43 and the toner receiving seal member 50 can also be removed.

The present disclosure is not limited to the above-described embodiment, and various modifications are possible within the scope of the present disclosure. For example, in the belt cleaning unit 19 according to the above-described embodiment, the fur brush 41 and the collecting roller 43 both serve as cleaning members. However, the present disclosure may also be applied to a structure in which only a fur brush is provided as a cleaning member, and which includes a scraper for scraping off toner from the surface of the fur brush or a toner receiving seal member that contacts the surface of the fur brush. In this structure, the fur brush corresponds to a rotation member.

In addition, in the above-described embodiment, the present disclosure is applied to the belt cleaning unit 19 which removes residual toner from the surface of the intermediate transfer belt 8. However, the present disclosure may similarly be applied to the cleaning devices 5*a* to 5*d* that remove residual toner from the surfaces of the photoconductor drums 1*a* to 1*d*.

In addition, the present disclosure may be applied not only to tandem color image forming apparatuses as illustrated in FIG. 1, but also to various other image forming apparatuses, such as monochrome copy machines, digital multifunction machines, facsimile machines, and laser printers, which include cleaning devices.

The present disclosure is applicable to a cleaning device including a mechanism for removing residual toner from a surface of an image carrier by using a cleaning member. By applying the present disclosure to a cleaning device, toner, paper dust, etc., stuck between a cleaning member and a contact member that contacts a surface of the cleaning member can be easily removed by rotating the cleaning member in a reverse direction with a simple structure. As a result, the risk of cleaning failure can be effectively reduced.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A cleaning device comprising:

a housing having an opening that opposes an image carrier and a waste toner receiver that receives toner that has been scraped off from a surface of the image carrier;

a cleaning member including a rotation member that is rotated in a forward rotation direction, the cleaning member being positioned near the opening in the housing and removes residual toner from the surface of the image carrier;

a contact member positioned so as to be in contact with an outer peripheral surface of the rotation member;

a torque limiter located on a rotation shaft of the rotation member and capable of rotating independently of the rotation shaft when a torque that is greater than or equal to a predetermined torque is applied to the torque limiter;

an urging member that applies an urging force to the torque limiter in a reverse rotation direction; and when T1 is a torque required to rotate the torque limiter independently of the rotation shaft, T2 is a rotation torque of the rotation member, F is an urging force of the urging member, and L is a distance between a position at which the urging member urges the torque limiter and a rotation center of the torque limiter, $(F \times L) < T1 < T2 - (F \times L)$ is satisfied.

2. The cleaning device according to claim 1, wherein a projection that projects toward the housing is formed on a side surface of the torque limiter that opposes the housing and an arc-shaped cut that is centered on the rotation shaft is formed in a side surface of the housing that opposes the side surface of the torque limiter, the projection engages with the cut so that the torque limiter is rotatable with respect to the housing within a range corresponding to the cut.

3. The cleaning device according to claim 1, wherein the contact member is a scraper that scrapes off waste toner from the outer peripheral surface of the rotation member.

4. The cleaning device according to claim 1, wherein the contact member is a toner receiving seal member that prevents waste toner from flowing from the waste toner receiver toward the opening.

5. The cleaning device according to claim 1, wherein the cleaning member includes a cleaning roller that scrapes off the residual toner from the surface of the image carrier and a collecting roller that collects waste toner that has adhered to a surface of the cleaning roller, and the contact member opposes the collecting roller over an entire length of the collecting roller.

6. The cleaning device according to claim 5, wherein a driving input gear train that drives the cleaning roller and the collecting roller in association with each other is connected to the cleaning device, the driving input gear train including a one-way clutch that transmits a driving force only in one direction.

7. The cleaning device according to claim 5, wherein the image carrier is an intermediate transfer belt, and the cleaning roller is a fur brush that scrapes off the residual toner from a surface of the intermediate transfer belt.

8. An intermediate transfer unit, comprising:

a housing having an opening that opposes an image carrier and a waste toner receiver that receives toner that has been scraped off from a surface of the image carrier;

a cleaning member including a rotation member that is rotated in a forward rotation direction, the cleaning member being positioned near the opening in the housing and removes residual toner from the surface of the image carrier;

a contact member positioned so as to be in contact with an outer peripheral surface of the rotation member;

a torque limiter located on a rotation shaft of the rotation member and capable of rotating independently of the rotation shaft when a torque that is greater than or equal to a predetermined torque is applied to the torque limiter;

an urging member that applies an urging force to the torque limiter in a reverse rotation direction; and when T1 is a torque required to rotate the torque limiter independently of the rotation shaft, T2 is a rotation torque of the rotation member, F is an urging force of the urging member, and L is a distance between a position at which the urging member urges the torque limiter and a rotation center of the torque limiter, $(F \times L) < T1 < T2 - (F \times L)$ is satisfied; and an intermediate transfer belt from which the residual toner is removed by the cleaning device.

9. An image forming apparatus comprising:

a cleaning device comprising:

a housing having an opening that opposes an image carrier and a waste toner receiver that receives toner that has been scraped off from a surface of the image carrier;

a cleaning member including a rotation member that is rotated in a forward rotation direction, the cleaning member being positioned near the opening in the housing and removes residual toner from the surface of the image carrier;

a contact member positioned so as to be in contact with an outer peripheral surface of the rotation member;

a torque limiter located on a rotation shaft of the rotation member and capable of rotating independently of the rotation shaft when a torque that is greater than or equal to a predetermined torque is applied to the torque limiter;

an urging member that applies an urging force to the torque limiter in a reverse rotation direction; and when T1 is a torque required to rotate the torque limiter independently of the rotation shaft, T2 is a rotation torque of the rotation member, F is an urging force of the urging member, and L is a distance between a position at which the urging member urges the torque limiter and a rotation center of the torque limiter, $(F \times L) < T1 < T2 - (F \times L)$ is satisfied.

* * * * *